US009941045B2

(12) United States Patent
Pollock et al.

(10) Patent No.: US 9,941,045 B2
(45) Date of Patent: Apr. 10, 2018

(54) BOBBIN DESIGN FOR CONDUCTION-COOLED, GAPPED, HIGH-PERMEABILITY MAGNETIC COMPONENTS

(71) Applicant: Tesla Motors, Inc., Palo Alto, CA (US)

(72) Inventors: Jennifer D Pollock, San Francisco, CA (US); William T. Chi, Mountain View, CA (US); Don Chiu, Santa Clara, CA (US)

(73) Assignee: Tesla, Inc., Palo Alto, CA (US)

( * ) Notice: Subject to any disclaimer, the term of this patent is extended or adjusted under 35 U.S.C. 154(b) by 197 days.

(21) Appl. No.: 14/648,241

(22) PCT Filed: Nov. 27, 2013

(86) PCT No.: PCT/US2013/072379
§ 371 (c)(1),
(2) Date: May 28, 2015

(87) PCT Pub. No.: WO2015/047429
PCT Pub. Date: Apr. 2, 2015

(65) Prior Publication Data

US 2015/0318106 A1 Nov. 5, 2015

Related U.S. Application Data

(60) Provisional application No. 61/733,831, filed on Dec. 5, 2012.

(51) Int. Cl.
*H01F 27/30* (2006.01)
*H01F 27/32* (2006.01)
(Continued)

(52) U.S. Cl.
CPC ..... *H01F 27/325* (2013.01); *H01F 27/022* (2013.01); *H01F 27/085* (2013.01);
(Continued)

(58) Field of Classification Search
CPC ..... H01F 27/00–27/36
(Continued)

(56) References Cited

U.S. PATENT DOCUMENTS 6,771,157 B2 * 8/2004 Nishikawa ..... H01F 3/14 336/178
2003/0080844 A1 5/2003 Nishikawa
2004/0036568 A1 2/2004 Suzuki

FOREIGN PATENT DOCUMENTS

CN 1220223 A 6/1999
CN 2857173 1/2017
(Continued)

OTHER PUBLICATIONS

International preliminary report on patentability in application PCT/US2013/072379, dated Jun. 9, 2015, 7 pages.
(Continued)

*Primary Examiner* — Tuyen Nguyen
(74) *Attorney, Agent, or Firm* — Garlick & Markison; Bruce E. Garlick

(57) ABSTRACT

A coil former, also referred to herein as a bobbin, is provided for use in conduction-cooled magnetic components that contain an air gap. The diameter of the disclosed bobbin is increased and ribs/splines or tabs are created to keep the winding centered about the core center post while allowing thermally conductive silicone-based or equivalent encapsulant to fill the voids between the coil former and the core, the coil former and the windings and/or both depending on the placement of the locating tabs. The disclosed bobbin may be fabricated from traditional injection molding resins or from high-thermal conductivity resins. As a result of the disclosed bobbin designs, the achievable power density is increased while maintaining acceptable temperatures.

16 Claims, 5 Drawing Sheets

(51) Int. Cl.

| | |
|---|---|
| ***H01F 27/26*** | (2006.01) |
| ***H01F 41/02*** | (2006.01) |
| ***H01F 41/12*** | (2006.01) |
| ***H01F 27/08*** | (2006.01) |
| ***H01F 27/02*** | (2006.01) |
| ***H01F 27/28*** | (2006.01) |

(52) U.S. Cl.
CPC ..... *H01F 27/263* (2013.01); *H01F 27/2876* (2013.01); *H01F 27/30* (2013.01); *H01F 27/327* (2013.01); *H01F 41/0206* (2013.01); *H01F 41/125* (2013.01); *Y10T 29/49075* (2015.01)

(58) Field of Classification Search
USPC ..... 336/65, 83, 196, 198, 206–208, 210
See application file for complete search history.

(56) References Cited

FOREIGN PATENT DOCUMENTS

| | | | | |
|---|---|---|---|---|
| JP | 63-147304 | A | | 6/1988 |
| JP | 05-217767 | A | | 8/1993 |
| JP | 08-138954 | A | | 5/1996 |
| JP | 11345715 | A | * | 12/1999 |
| JP | 2000-188224 | A | | 7/2000 |
| JP | 2001-155942 | A | | 6/2001 |

OTHER PUBLICATIONS

International search report in application PCT/US2013/072379, dated Jan. 9, 2015, 11 pages.
State Intellectual Property Office; Search Report; Application No. 201380063922.0; dated Apr. 4, 2017; 2 pgs.

* cited by examiner

BOBBIN DESIGN FOR CONDUCTION-COOLED, GAPPED, HIGH-PERMEABILITY MAGNETIC COMPONENTS

CROSS-REFERENCE TO RELATED APPLICATION

This application claims the benefit of the filing date of U.S. provisional patent application 61/733,831, filed Dec. 5, 2012, the contents of which are hereby incorporated herein by reference.

BACKGROUND

U.S. Patent Publication Serial No. 2004/0036568, filed 8 Jul. 2003, discloses a coil bobbin formed of a heat resistant plastic resin that only deforms slightly under heat. The disclosed coil bobbin includes a core housing about which magnetic wire is wound. The magnetic core includes two core sections. Inner surfaces of the core housing include core spacing mechanisms that control the position of the magnetic core inserted into the core housing.

SUMMARY

A coil former, also referred to herein as a bobbin, is provided for use in conduction-cooled magnetic components that contain an air gap. The diameter of the disclosed bobbin is increased and ribs/splines or tabs are created to keep the winding centered about the core center post while allowing thermally conductive silicone-based or equivalent encapsulant to fill the voids between the coil former and the core, the coil former and the windings and/or both depending on the placement of the locating tabs. The disclosed bobbin may be fabricated from traditional injection molding resins or from high-thermal conductivity resins. As a result of the disclosed bobbin designs, the achievable power density is increased while maintaining acceptable temperatures.

A further understanding of the nature and advantages of the present invention may be realized by reference to the remaining portions of the specification and the drawings.

DETAILED DESCRIPTION

Figure 1:
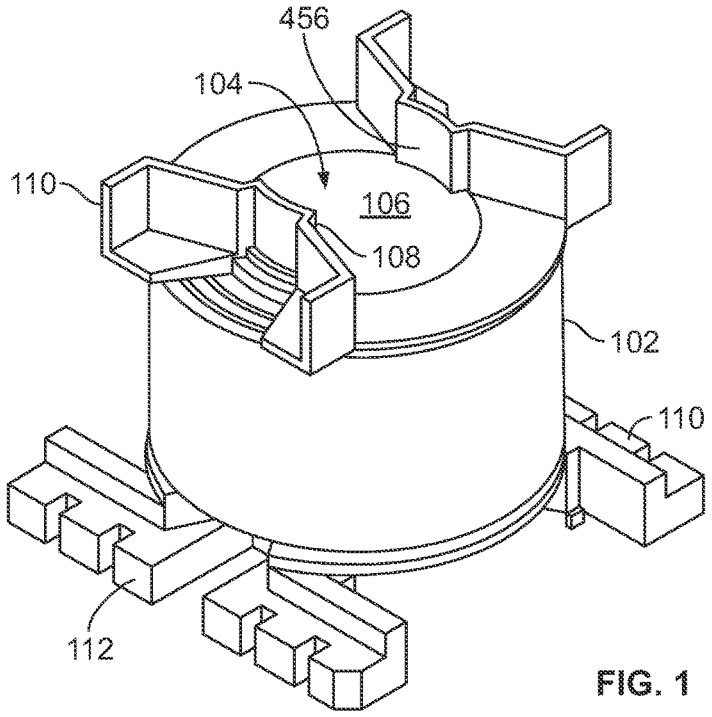
FIG. 1 shows an elevation view of an example bobbin with a winding.

A coil former, also referred to herein as a bobbin, is provided for use in conduction-cooled magnetic components that contain an air gap in a high-permeability magnetic path as commonly found in gapped ferrite inductors and transformers. The total winding loss is reduced when the windings are spaced away from regions that contain a strong magnetic field/flux density and the air gap in the high-permeability magnetic path creates a strong magnetic field. The air gap is placed in the center leg only to contain the magnetic fields, but it is difficult to get the heat out from the core and the center windings. The space between the winding and the core is increased to reduce power losses and this space is utilized for conduction cooling. The diameter of the new bobbin is increased and ribs/splines or tabs are created to keep the winding centered around the core center post while allowing thermally conductive silicone-based or equivalent encapsulant to fill the voids winding-to-bobbin and bobbin-to-core. Existing bobbins do not provide pathways between the bobbin and the core for encapsulant and, as a result, allow air pockets to develop in this region.

The present bobbin design in some implementations allows encapsulant to be channeled in to fill desired spaces between the coil former and the core, the coil former and the windings and/or both depending on the placement of the locating tabs. The coil former may be fabricated of traditional injection molding resins or high-thermal conductivity resins, such as thermally-filled LCP, PPS resins (ie. 2-20 W/mK) to achieve the desired thermal paths. As a result of the disclosed bobbin designs, the achievable power density of power magnetic components is increased since more power can be handled in a smaller space while maintaining acceptable temperatures in the component system.

Additional benefits of the present design in some implementations include (i) less stress on the core because more of the surface area direct conduction cooling of encapsulant, (ii) ease of assembly because the encapsulation process may not require vacuum or pressure, and (iii) increases the surface area in which the encapsulant is exposed to ambient air and atmospheric pressure to accommodate the encapsulant's CTE (coefficient of thermal expansion). There may be cases where it is advantageous to keep the encapsulant away from the higher temperatures of the winding is order to meet the RTI of the encapsulant for UL and other certifications.

Note that given the difficulties associated with manufacturing a spiral, it may be beneficial to make the bobbin with centering-alignment tabs as shown in some of the accompanying figures. Vertical splines may also be used, depending upon the area that needs additional cooling. Use of Teflon extrusions or silicone wire insulation systems allows greater flexibility in bobbin walls and tab locators while still meeting UL or equivalent material thermal specifications.

The present invention in some implementations solves the problem of how to get heat out of a power magnetic component while increasing its overall power density. In a preferred embodiment, the developed design uses the isolation transformer design for a charger that is a 3.7 kW LLC resonant converter operating between 150-300 kHz. The isolation transformer for this converter needs to have a stable magnetizing inductance as part of the resonant tank which is accomplished with the use of a gapped high-permeability power ferrite material.

Preferably the winding loss is reduced by spacing the winding away from the gap which in itself leads to lower winding losses. The present invention utilizes this space for conduction cooling of the winding and core thru a silicone encapsulant or equivalent, thus increasing the achievable power density of the component.

FIG. 1 shows an elevation view of an example bobbin 100 with a winding 102. The bobbin is configured for use in a conduction-cooled magnetic component, such as a transformer or a resonance inductor, and will have at least one leg of a core component (exemplified below) inserted in a center cavity 104. In some implementations, one or more instances of a magnetic component can be included in the power electronics of an electric vehicle, such as in the charger assembly thereof. For example, an onboard charger of an electric vehicle can have three sets of such magnetic components each consisting of a transformer and a resonance inductor.

The bobbin 100 can be made of a thermally conductive material. In some implementations, heat generated in the core (e.g., due to a fringing field in a gap between opposing core legs) can be conducted out from the center of the core and into the material of the bobbin. An encapsulant material can be provided in the gap between core legs to form a thermal path for the heat. Such encapsulated material can contact the thermally conductive bobbin. For example, the bobbin can be manufactured from a resin that provides a number of times the thermal conductivity of standard plastic material. The thermally conductive bobbin can reject the generated heat elsewhere, such as into the ambient surrounding or into a heat sink.

An inner surface 106 of the bobbin is shown to be an essentially smooth cylindrical surface in this example. In some implementations, one or more spacers can be provided inside the bobbin. Here, structures 108 that are complementary to each other and located just outside the cavity are configured to serve as spacers by abutting against the core leg.

Features 110 can serve for mounting the bobbin, optionally after having the core portion(s) assembled thereto, in a vessel or other enclosure (not shown), such as an aluminum housing. For example, two E-shaped core portions can be mounted together so that the respective legs thereof abut each other (or so that a predefined gap is formed). As another example, U-shaped cores can be used. Also, features 112 can be used for mounting pins and/or terminals that are part of the electrical connections for the magnetic component.

The winding 102 includes one or more layers of conductive wires that will be involved in the operation of the finished magnetic device. For example, the winding can include one or more winding sections that correspond to the primary or secondary, or it can consist of a single winding.

Figure 2:
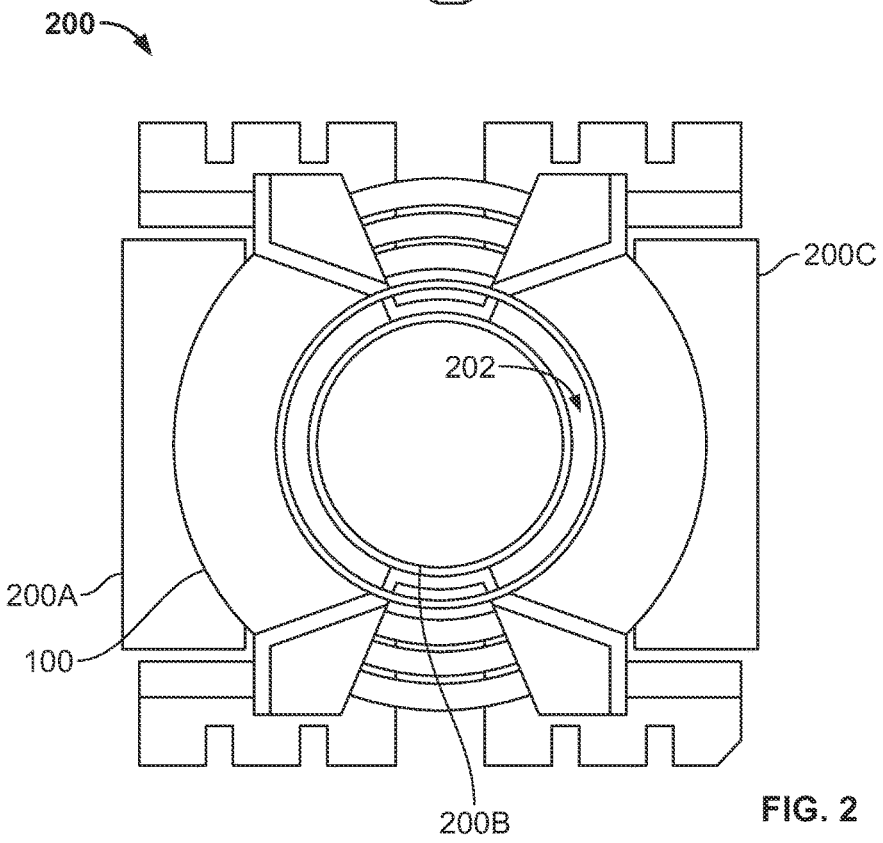
FIG. 2 shows a top view of the bobbin shown in FIG. 1 with a core portion.

FIG. 2 shows a top view of the bobbin 100 shown in FIG. 1 with a core portion 200. That is, the bobbin and the core portion have now been assembled as part of the process of manufacturing the magnetic component. The core portion is made of a magnetic material (e.g., ferrite in a ceramic matrix) and includes one or more core legs. The core portion can include a left leg 202A, a center leg 202B, and a right leg 202C. Here, the center leg has a circular profile and the other two legs are substantially rectangular. Later in the assembly, an opposing core portion can be added to complement the one shown.

Between the center leg 200B and a surface of the bobbin 100 is formed a gap 202 which can be partially or completely filled with encapsulant material. For example, such material can be a thermally conductive silicone-based compound that is liquid during an injection phase (i.e., while the magnetic component is being manufactured) and that later sets or cures into a solid phase. For example, the setting can occur due to the passage of time, or it can be triggered by elevated temperature (e.g., in an oven).

Figure 3:
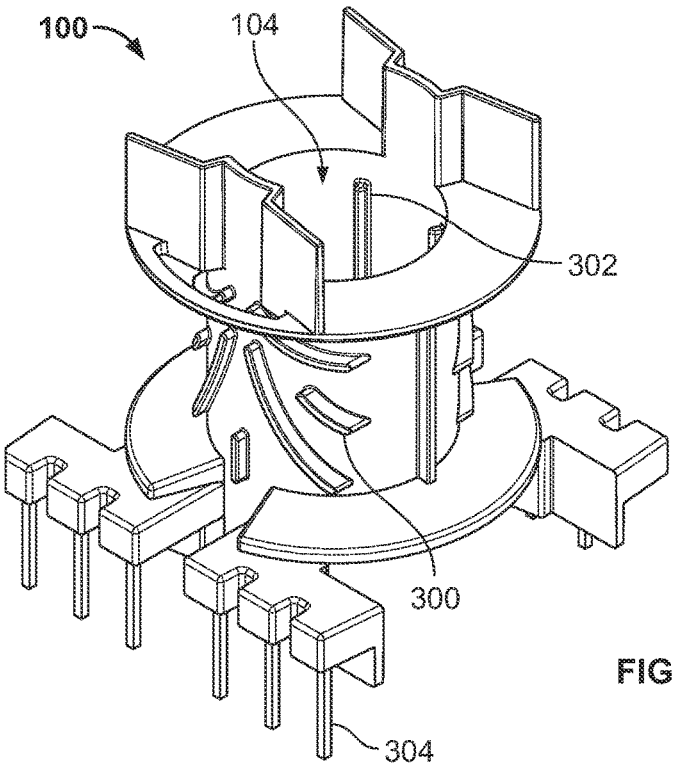
FIG. 3 shows an elevation view of the bobbin in FIG. 1.

FIG. 3 shows an elevation view of the bobbin 100 in FIG. 1. Here, the bobbin is shown without the winding(s) and the core portion(s), for clarity. In this example, the bobbin is single walled and has spacers 300 on its outer surface and spacers 302 on its inner surface. The spacers 300 can serve to create a gap between the bobbin and the winding; that is, the winding wire(s) will be wound around the bobbin onto the spacers 300. The spacers 302 can serve to create a gap between the bobbin and the center leg of the core; that is, the spacers ensure that the center leg does not directly contact the bobbin.

Such created spaces can serve one or more purposes. For example, the space(s) can provide one or more channels for inserting an encapsulant material, which can serve as a thermal path to remove heat from the center of the magnetic component. As another example, the space(s) can provide separation between the winding and a gap between core legs; such separation can reduce winding losses.

Figure 4:
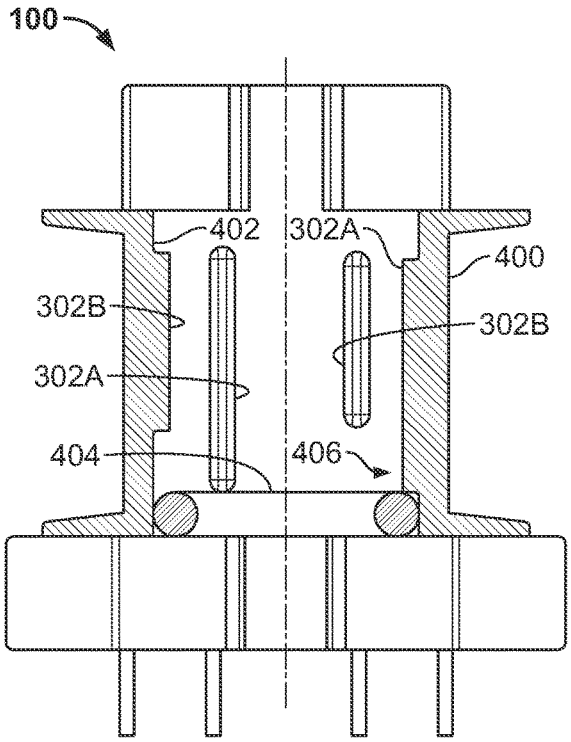
FIG. 4 shows a cross section of the bobbin in FIG. 3.

In the illustrated example, pins 304 were mounted on the bobbin 100. FIG. 4 shows a cross section of the bobbin 100 in FIG. 3. An outer surface 400 of the bobbin is configured to have one or more of the outer spacers formed thereon or attached thereto, which outer spacers are not shown for clarity. An inner surface 402 has the spacers 302 formed thereon or attached thereto. Here, the inner spacers are substantially linear and extend essentially in the direction that the core center leg(s) will be inserted.

Some inner spacers can be oriented differently or have different length or size, than other inner spacers. For example, here inner spacers 302A are configured to abut against a seal 404 (e.g., an o-ring), whereas inner spacers 302B are configured to create an opening 406 next to the seal. For example, such opening(s) can aid in providing thermal pathways because they aid the encapsulant material in flowing into various areas of the magnetic component. In assembly, the seal can be mounted on the center core leg, and when the leg is inserted into the cavity of the bobbin, the longer spacers (i.e., spacers 302A) help in seating the seal in the correct place. Stated somewhat differently, the contact between the spacers 302A and the seal can ensure the correct position of the bobbin relative to the core.

Figure 5A:
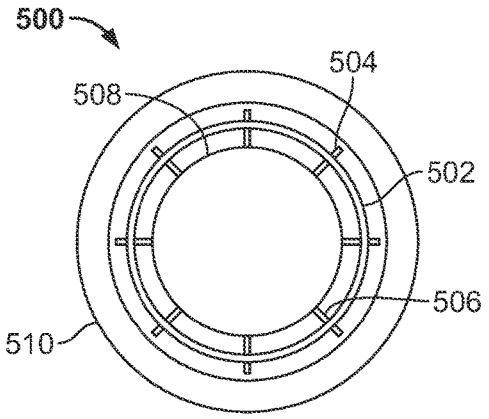
FIG. 5A shows a top view of an example magnetic component with a bobbin having external spacers and internal spacers.

That is, spacing can be provided near the bobbin, on the inside and/or on the outside, and such spacing can then be partially or completely filled with encapsulant material. Spacing can be created in any of various ways, for example as will now be described. FIG. 5A shows a top view of an example magnetic component 500 with a bobbin 502 having external spacers 504 and internal spacers 506. In these schematic illustrations, the magnetic component is in the process of being manufactured and is not yet ready for use as a magnetic component. The bobbin encloses a core center leg 508 and is surrounded by a winding 510. This and similar implementations can be characterized in that they allow encapsulant material to be located both near the core and near the winding. As such, the implementations can serve to cool both the core and the winding.

The internal and/or external spacers can be oriented in different ways. For example, the spacer(s) can be essentially linear, or arced. In some implementations, the spacers 504 and/or 506 can be staggered from each other in one or more directions.

Figure 5B:
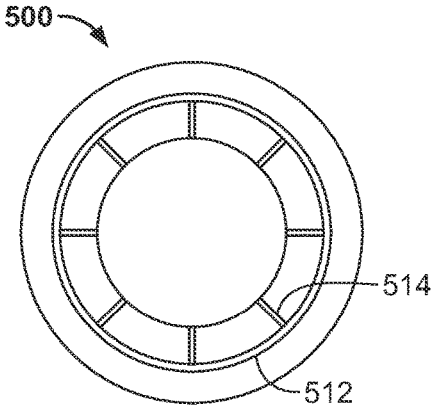
FIG. 5B shows a top view of the magnetic component of FIG. 5A with a bobbin having inward spacers.

FIG. 5B shows a top view of the magnetic component 500 of FIG. 5A with a bobbin 512 having inward spacers 514. That is, adjacent spacers form channels for encapsulant material, and in each of these channels the material can be in contact with the core and therefore conduct thermal energy that is generated in the core. This and similar implementations can be characterized as providing relatively more cooling of the core than of the winding. One or more of the spacers can be essentially linear or arced, and/or spacers can be staggered from each other in one or more directions.

Figure 5C:
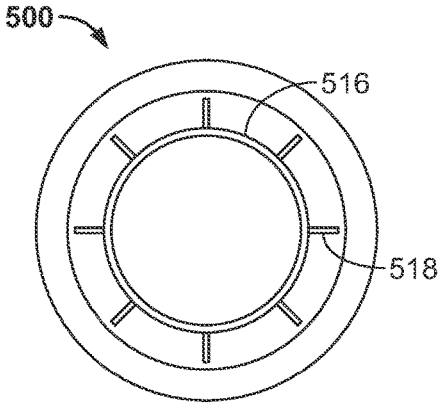
FIG. 5C shows a top view of the magnetic component of FIG. 5A with a bobbin having outward spacers.

FIG. 5C shows a top view of the magnetic component 500 of FIG. 5A with a bobbin 516 having outward spacers 518. Here, the channels formed by the spacers allow the encapsulant material to contact the inside of the winding, and this and similar implementations can therefore be characterized as providing relatively more cooling of the winding than of the core.

Figure 5D:
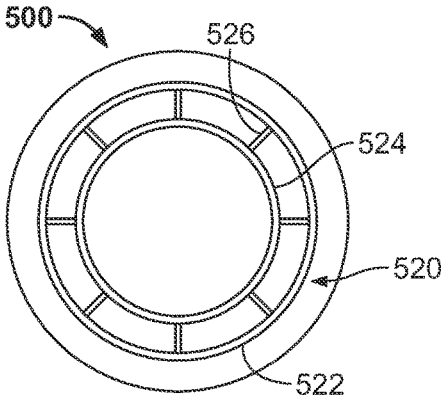
FIG. 5D shows a top view of the magnetic component of FIG. 5A with a bobbin having concentric cylinder walls connected by members.

FIG. 5D shows a top view of the magnetic component 500 of FIG. 5A with a bobbin 520 having concentric cylinder walls 522 and 524 connected by members 526.

Figure 5E:
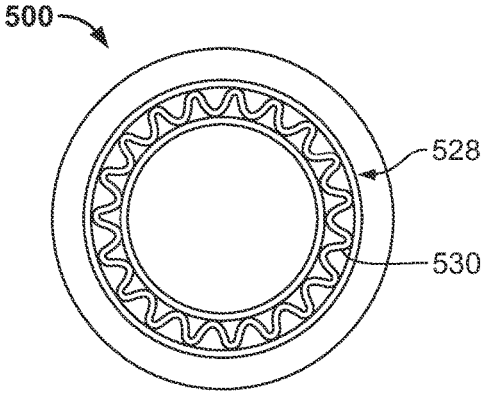
FIG. 5E shows a top view of the magnetic component of FIG. 5A with a bobbin having an undulating member.

FIG. 5E shows a top view of the magnetic component 500 of FIG. 5A with a bobbin 528 having an undulating member 530. The bobbin can have a cylindrical wall. For example, the undulating member can be attached to an inner wall and/or an outer wall.

Figure 6:
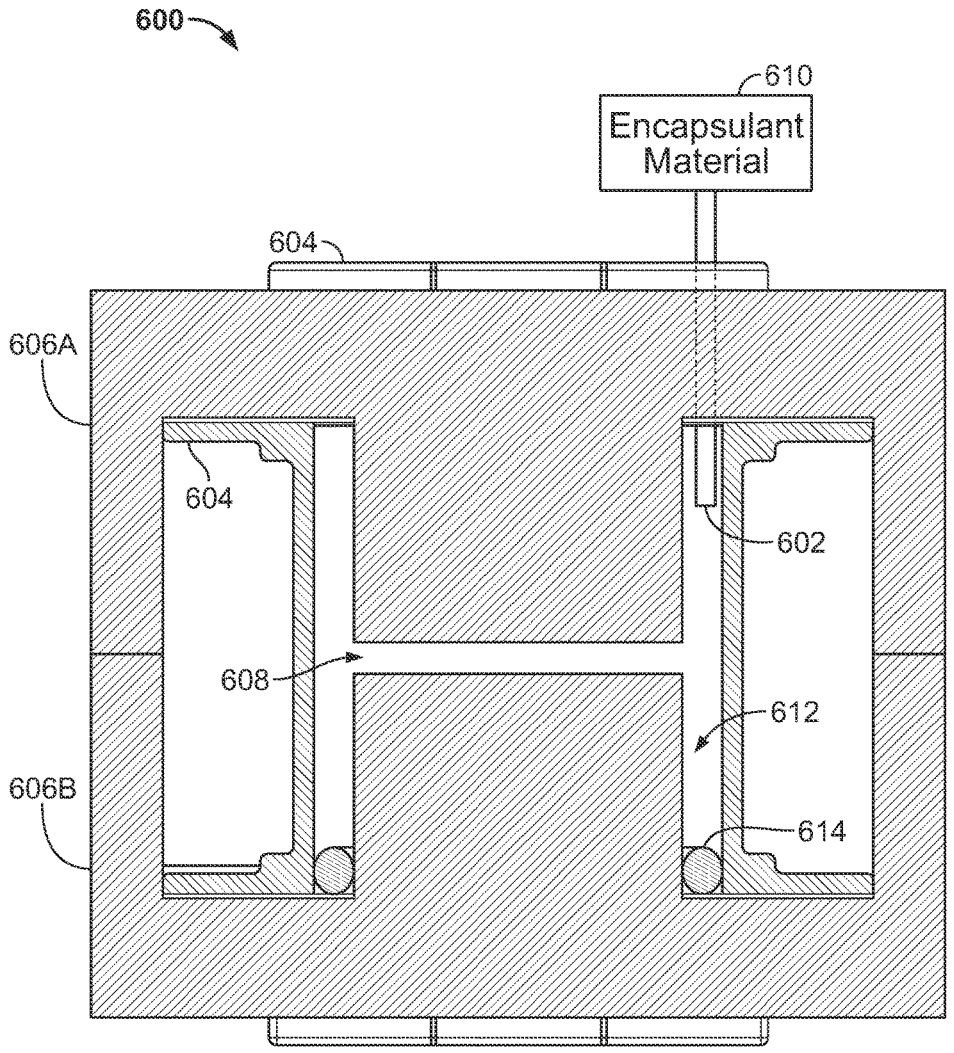
FIG. 6 shows a cross section of a magnetic component and an injection needle for encapsulant material.

FIG. 6 shows a cross section of a magnetic component 600 and an injection needle 602 for encapsulant material. A bobbin 604 will be used for holding the winding of the component and for spacing the winding from the core, and the winding is here omitted for simplicity. The magnetic component is currently in the stage of the manufacturing process when encapsulant material is being injected into the interior of the component. Particularly, the component has a core that consists of an upper core portion 606A and a lower core portion 606B. The core portions are configured so that the center legs form a gap 608 between them when assembled.

The injection needle 602 extends into the area between the bobbin and the center leg. For example, when the upper core portion is mounted on the bobbin the core can leave some area of the bobbin uncovered, so that the needle can reach the interior of the bobbin in that location and any similar such access places. The needle is connected to a reservoir 610 of encapsulant material such that the material can flow into the bobbing by gravity, and/or can be injected by way of pressure/suction being applied.

The encapsulant material can be made to fill as much of the available space inside the magnetic component as is desired. For example, a gap 612 between the center leg and the bobbin, as well as the gap 608, can be filled. In such cases, the flow of encapsulant can be guided by one or more internal spacers. For example, a seal 614 can prevent the encapsulant from leaking out of the intended filling space. As another example, when one or more external spacers are used, the encapsulant can reach a gap between the bobbin and the winding (not shown). In some implementations, the encapsulant reaches such bobbin-winding gap by way of one or more openings in the bobbin body. In other implementations, the injection needle 602 can be inserted in another position that provides access to the space between the winding and the bobbin.

Figure 7:
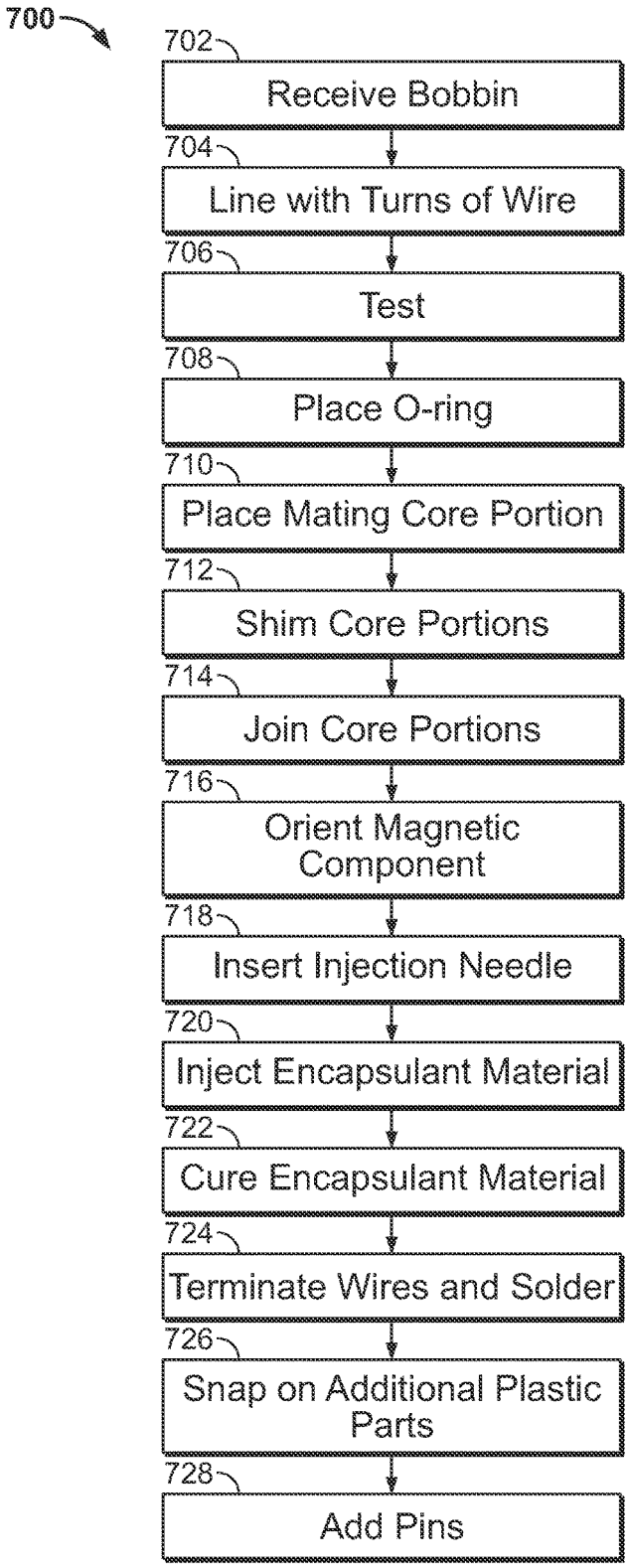
FIG. 7 shows an example flowchart of a method.

FIG. 7 shows an example flowchart of a method 700. In some implementations, the method can be performed in manufacturing a magnetic component. One or more additional or fewer steps can be performed. As another example, one or more steps can be performed in a different order.

At 702, a bobbin is received. For example, any of the bobbins described herein can be manufactured, such as by an injection molding process.

At 704, the bobbin is lined with a selected number of turns of electric wire. That is, this forms the winding on the bobbin for the magnetic component.

At 706, The winding can be tested in one or more ways. For example, it can be tested that the winding has the electrical properties required for the type of component being made.

At 708, an o-ring or other seal can be placed on the bobbin and/or on a portion of the core. For example, the o-ring can be mounted on a cylindrical center portion of the core and the bobbing can have a corresponding portion (e.g., an internal spacer) that will abut the o-ring when the bobbing and the core portion are assembled.

At 710, the mating core portion can be placed onto the assembly. For example, the two core portions can be E-shaped or U-shaped, and can be placed so that corresponding legs are positioned opposite each other. In some implementations, the core is manufactured so that a gap is created between the opposing center legs when assembled. For example, the center legs can be machined to a shorted length.

In other implementations, the gap between center core legs can be otherwise created. For example, at 712 the core portions can be shimmed away from each other a certain distance by inserting one or more shims. For example, this can provide a gap also between other core legs (e.g., the left and right legs), each gap having its own fringe field.

At 714, the core portions are joined to each other. For example, insulating tape, or a metal spring, can be applied so as to hold the core portions, and thereby the bobbin enclosed between them, in the correct position.

At 716, the magnetic component can be oriented in a position selected for encapsulant injection. For example, the component can be standing up (e.g., similar to the illustration in FIG. 6) and the encapsulant can be injected from above. As another example, the magnetic component can be lying down and encapsulant can then be injected essentially in a horizontal direction.

At 718, the injection needle can be inserted. For example, the core portion may provide access to the bobbin where needed.

At 720, the encapsulant material is injected. The amount of material can be selected based on how much of the available space should be filled with the encapsulant. For example, the encapsulant allows thermal energy to be transferred from electromagnetic components (e.g., the core and the winding) into a heat sink.

At 722, the encapsulant material can be cured. For example, this can require heating in an oven, or simply the passing of sufficient time.

At 724, the wires can be terminated and soldered. For example, the appropriate contacts for the electric wires of the magnetic component can be provided.

At 726, one or more additional plastic parts can be snapped onto, or otherwise be attached to, the assembly. Such parts can facilitate enclosing the magnetic component in a housing, and/or to space certain sides of the component closer to a heat sink, to name just a few examples.

At 728, one or more pins can be added to the part of the bobbin that is exposed at this stage of assembly. For example, the pins illustrated in FIGS. 3-4 can be mounted on the bobbin.

A number of implementations have been described as examples. Nevertheless, other implementations are covered by the following claims.

What is claimed is:

1. A conduction-cooled magnetic component comprising:

core portions that are complementary to each other, configured so that a predefined gap is formed between at least first opposing core legs and so that at least second opposing core legs abut each other;

first encapsulant material in the predefined gap;

a bobbin that encloses the first opposing core legs, wherein the first encapsulant material contacts the bobbin;

a winding on the bobbin, the bobbin having first spacers on an inward surface of a wall of the bobbin configured to direct flow of the first encapsulant material between the inward surface of the wall of the bobbin and the first opposing core legs, and second spacers on an outward surface of the wall of the bobbin configured to direct flow of second encapsulant material between the outward surface of the wall of the bobbin and the winding; and a seal for the first encapsulant material located between one of the first opposing core legs and the bobbin.

2. The conduction-cooled magnetic component of claim 1, wherein the second spacers are arced and staggered on the outward surface.

3. The conduction-cooled magnetic component of claim 1, wherein the bobbin comprises inner and outer concentric cylinder walls connected by at least one member.

4. The conduction-cooled magnetic component of claim 3, wherein the inner and outer concentric cylinder walls are connected by essentially linear members.

5. The conduction-cooled magnetic component of claim 3, wherein the member undulates between the inner and outer concentric cylinder walls.

6. The conduction-cooled magnetic component of claim 1, wherein the first encapsulant material substantially fills the predefined gap.

7. The conduction-cooled magnetic component of claim 1, further comprising another gap between the inward surface and the first opposing core legs, wherein the first encapsulant material substantially fills the another gap.

8. A conduction-cooled magnetic component comprising:

a two-piece magnetic core, each piece of the two-piece magnetic core having a center leg, a right leg, and a left leg, the two-piece magnetic core assembled to form opposing center legs separated by a predefined gap, abutting right legs, and abutting left legs;

a bobbin surrounding the opposing center legs and including:

an inward surface adjacent the opposing center legs;

an outward surface adjacent the abutting right legs and the abutting left legs;

first spacers formed on the inward surface; and second spacers formed on the outward surface;

a winding on the bobbin in contact with the second spacers; and encapsulant material in the predefined gap and between the inward surface and the center legs.

9. The conduction-cooled magnetic component of claim 8, wherein the first spacers are configured to direct flow of the encapsulant material between the inward surface of the bobbin and the opposing center legs.

10. The conduction-cooled magnetic component of claim 9, wherein the second spacers are configured to direct flow of the encapsulant material between the outward surface of the bobbin and the winding.

11. The conduction-cooled magnetic component of claim 10, further comprising a seal for the encapsulant material.

12. The conduction-cooled magnetic component of claim 11, wherein the seal for the encapsulant material is located between one of the opposing center legs and the bobbin.

13. The conduction-cooled magnetic component of claim 8, wherein the second spacers are arced and staggered on the outward surface of the bobbin.

14. The conduction-cooled magnetic component of claim 8, wherein the bobbin comprises inner and outer concentric cylinder walls connected by at least one member.

15. The conduction-cooled magnetic component of claim 14, wherein the inner and outer concentric cylinder walls are connected by essentially linear members.

16. The conduction-cooled magnetic component of claim 14, wherein the at least one member undulates between the cylinder walls.

* * * * *